US011224314B2

(12) United States Patent
Albrecht

(10) Patent No.: US 11,224,314 B2
(45) Date of Patent: Jan. 18, 2022

(54) WEB MATERIAL CENTER-PULL DISPENSER ASSEMBLY

(71) Applicant: San Jamar, Inc., Elkhorn, WI (US)

(72) Inventor: Brian Albrecht, Elkhorn, WI (US)

(73) Assignee: San Jamar, Inc., Elkhorn, WI (US)

( * ) Notice: Subject to any disclaimer, the term of this patent is extended or adjusted under 35 U.S.C. 154(b) by 0 days.

(21) Appl. No.: 16/428,239

(22) Filed: May 31, 2019

(65) Prior Publication Data

US 2020/0375414 A1 Dec. 3, 2020

(51) Int. Cl.

| | |
|---|---|
| ***A61J 7/04*** | (2006.01) |
| ***B65B 61/06*** | (2006.01) |
| ***G07F 11/42*** | (2006.01) |
| ***A61J 7/00*** | (2006.01) |
| ***B65B 61/28*** | (2006.01) |
| ***A47K 10/38*** | (2006.01) |
| *A47K 10/32* | (2006.01) |

(52) U.S. Cl.

CPC ..... *A47K 10/38* (2013.01); *A47K 2010/3266* (2013.01)

(58) Field of Classification Search

CPC ..... A47K 10/38; A47K 10/3818; A47K 2010/3266

See application file for complete search history.

(56) References Cited

U.S. PATENT DOCUMENTS

| | | | | |
|---|---|---|---|---|
| 995,203 | A * | 6/1911 | Thomas et al. ..... | B65D 47/265 220/253 |
| 1,297,119 | A | 3/1919 | Davis | |
| 1,362,449 | A | 12/1920 | Teall | |
| 1,563,867 | A | 12/1925 | Krueger | |
| 1,649,273 | A | 11/1927 | Wilson | |
| 2,027,674 | A | 1/1936 | Broeren | |
| 2,108,825 | A | 2/1938 | Morris | |
| 2,434,206 | A | 1/1948 | Frieders | |
| 2,547,856 | A | 4/1951 | Cofrin et al. | |

(Continued)

FOREIGN PATENT DOCUMENTS

| | | |
|---|---|---|
| AU | 646471 B2 | 2/1994 |
| CA | 97650 S | 4/2003 |

(Continued)

*Primary Examiner* — Gene O Crawford

*Assistant Examiner* — Kelvin L Randall, Jr.

(74) *Attorney, Agent, or Firm* — Boyle Fredrickson S.C.

(57) ABSTRACT

A dispenser assembly and method of providing a web material dispenser assembly that is configured to dispense towel and wipe web materials, whether continuous or interwoven, in a pull-through manner from a core of a roll of material. The dispenser assembly includes a housing having a base and a moveable cover. A roll guide is disposed in the housing and defines a portion of the dispense passage associated with extraction of material from the dispenser assembly. A restrictor plate is supported by the roll guide and is rotatable and axially translatable relative thereto. The restrictor plate defines a number of dispense openings that can be selectively aligned with the portion of the dispense passage defined by the roll guide such that the characteristics associated with the pull-through dispense activity of the dispenser assembly can be quickly and conveniently configured to achieve a desired dispense action.

20 Claims, 6 Drawing Sheets

(56) References Cited

U.S. PATENT DOCUMENTS

D176,842 S 2/1956 D'Ath
2,852,158 A 9/1958 Jones et al.
3,028,047 A 4/1962 Tuft
3,203,586 A 8/1965 Downham
3,208,636 A 9/1965 Filipowicz
3,242,931 A * 3/1966 Wandrey ..... G07D 1/08 453/29
3,291,339 A 12/1966 Hein
3,370,748 A 2/1968 Koerper et al.
3,523,653 A 8/1970 Hansen
3,749,296 A 7/1973 Harrison
3,777,931 A 12/1973 Fleming
3,843,017 A 10/1974 Harrison
3,923,223 A 12/1975 Larsson et al.
D238,731 S 2/1976 Breger
3,973,695 A 8/1976 Ames
3,982,659 A 9/1976 Ross
4,009,682 A 3/1977 Patel et al.
4,094,442 A 6/1978 Radek
4,138,034 A 2/1979 McCarthy
4,171,047 A 10/1979 Doyle et al.
4,180,160 A 12/1979 Ogawa et al.
4,262,816 A 4/1981 Margulies
4,274,573 A 6/1981 Finkelstein
4,289,262 A 9/1981 Finkelstein
4,311,252 A 1/1982 Hope, Jr. et al.
4,314,679 A 2/1982 Paul et al.
4,343,415 A 8/1982 Radek
4,353,480 A 10/1982 McFadyen
4,462,507 A 7/1984 Margulies
4,524,895 A 7/1985 Lunden
4,526,291 A 7/1985 Margulies
4,534,491 A 8/1985 Norton et al.
4,579,266 A 4/1986 Bunger et al.
D285,995 S 10/1986 Minost
4,615,937 A 10/1986 Bouchette
4,651,895 A 3/1987 Niske et al.
4,706,844 A 11/1987 Omdoll et al.
D296,765 S 7/1988 Urion
4,760,970 A 8/1988 Larsson et al.
4,846,415 A 7/1989 Jernberg et al.
4,905,868 A 3/1990 Beane et al.
4,953,747 A 9/1990 Wenkman et al.
4,979,617 A 12/1990 Benoit
5,006,267 A 4/1991 Vaughn et al.
5,065,924 A 11/1991 Granger
5,131,561 A 7/1992 Casperson et al.
5,131,903 A 7/1992 Levine et al.
5,137,173 A 8/1992 Hughes et al.
5,141,171 A 8/1992 Yang
5,152,121 A 10/1992 Nakamura
5,158,180 A 10/1992 Zucker
5,205,455 A 4/1993 Moody
5,211,308 A 5/1993 Decker et al.
5,215,211 A 6/1993 Eberle
5,219,126 A 6/1993 Schutz
5,246,137 A 9/1993 Schutz et al.
5,263,607 A 11/1993 Temesvary et al.
5,269,432 A 12/1993 Beckertgis
5,273,184 A 12/1993 Rizzuto
5,285,927 A 2/1994 Pruitt
5,310,083 A 5/1994 Rizzuto
5,332,118 A 7/1994 Muckenfuhs
5,346,064 A 9/1994 Rizzuto
5,358,140 A 10/1994 Pellegrino
5,370,338 A * 12/1994 Lewis ..... A47K 10/3818 242/593
5,421,898 A 6/1995 Cavanagh
5,467,893 A 11/1995 Landis, II et al.
5,480,060 A 1/1996 Blythe
5,523,816 A * 6/1996 Sherman, Jr. ..... G03D 13/005 221/131
5,542,567 A 8/1996 Julius
5,542,568 A 8/1996 Julius
5,560,514 A 10/1996 Frazier
5,577,634 A 11/1996 Morand
5,577,635 A 11/1996 Block
5,582,362 A 12/1996 Johnson et al.
D385,734 S 11/1997 Mervar et al.
5,697,576 A 12/1997 Bloch et al.
5,715,971 A 2/1998 Morand
5,718,353 A 2/1998 Kanfer et al.
5,749,492 A 5/1998 Petterson
5,762,286 A 6/1998 Schutz
5,762,287 A 6/1998 Schutz
5,765,718 A 6/1998 Grasso et al.
5,769,354 A 6/1998 Lindh et al.
D396,369 S 7/1998 Giugiaro
D403,543 S 1/1999 Grasso et al.
5,857,642 A 1/1999 Zinnbauer
5,868,346 A 2/1999 Cobos
D406,974 S 3/1999 King et al.
5,890,633 A 4/1999 Skillin et al.
6,024,323 A 2/2000 Palermo, Jr.
6,029,921 A 2/2000 Johnson
6,082,663 A 7/2000 Tramontina et al.
6,089,499 A 7/2000 Robinson
6,092,757 A 7/2000 Leytem
6,109,473 A 8/2000 Neveu et al.
6,129,240 A 10/2000 Morand
6,145,782 A 11/2000 King et al.
6,158,614 A 12/2000 Haines et al.
6,182,858 B1 2/2001 Hartog
6,189,726 B1 2/2001 Fick
6,189,730 B1 2/2001 McClymonds
6,267,321 B1 * 7/2001 Tramontina ..... A47K 10/3818 206/409
D449,474 S 10/2001 Conran et al.
6,328,252 B1 12/2001 Neveu et al.
6,387,871 B2 5/2002 Faber
D467,106 S 12/2002 Bohay
6,510,964 B2 1/2003 Paukov et al.
6,517,025 B1 2/2003 Budz
6,543,641 B2 4/2003 Hubanks et al.
6,575,397 B1 6/2003 Tranmontina et al.
6,585,130 B2 7/2003 Turbett et al.
6,592,001 B2 7/2003 Lewis et al.
6,592,002 B2 7/2003 Clark et al.
6,629,667 B2 10/2003 Tramontina
6,634,037 B2 10/2003 Turbett et al.
6,695,247 B2 2/2004 Widlund
D488,655 S 4/2004 Tramontina et al.
6,758,434 B2 7/2004 Kapiloff et al.
6,769,589 B2 * 8/2004 Paukov ..... A47K 10/3818 221/304
6,848,594 B2 2/2005 Holland
6,869,041 B1 3/2005 Allegre et al.
6,959,891 B2 11/2005 Kapiloff et al.
6,964,395 B1 11/2005 Lewis et al.
7,025,301 B1 4/2006 Notarnicola
7,028,945 B2 4/2006 Formon et al.
7,040,568 B2 5/2006 Lewis et al.
D522,785 S 6/2006 Brady
7,070,143 B2 7/2006 Faulks et al.
7,111,805 B2 9/2006 Notarnicola
7,131,609 B1 * 11/2006 Lewis ..... A47K 10/3818 242/593
7,178,689 B2 2/2007 Wieser et al.
7,275,655 B2 10/2007 Duff
7,275,672 B2 10/2007 Haen et al.
7,287,720 B1 10/2007 Allegre et al.
D568,655 S 5/2008 Friesen et al.
7,510,137 B2 * 3/2009 Tramontina ..... A47K 10/3818 242/593
7,530,460 B2 5/2009 Lewis et al.
7,530,471 B2 5/2009 Cohen et al.
7,546,973 B2 6/2009 Budz et al.
7,648,098 B2 1/2010 Goeking et al.
D613,538 S 4/2010 Cattacin et al.
D615,330 S 5/2010 Meyerhoffer
D623,453 S 9/2010 Benedetti
D625,535 S 10/2010 Cattacin et al.
7,806,291 B2 10/2010 Anderson
7,856,941 B2 12/2010 Nelson et al.

(56) References Cited

U.S. PATENT DOCUMENTS

| | | | | |
|---|---|---|---|---|
| 7,878,368 | B2 | 2/2011 | Friesen et al. | |
| 7,922,034 | B2 | 4/2011 | Neveu et al. | |
| 7,997,443 | B2 | 8/2011 | Titas et al. | |
| 7,997,522 | B2 | 8/2011 | Titas et al. | |
| 8,256,700 | B2 | 9/2012 | Billman et al. | |
| 8,505,770 | B2 | 8/2013 | Askinasi | |
| 8,555,761 | B2 | 10/2013 | Keily et al. | |
| 8,573,398 | B2 | 11/2013 | Reinke et al. | |
| 8,616,486 | B2 | 12/2013 | Billman et al. | |
| 8,684,228 | B2 | 4/2014 | Parker | |
| 8,720,813 | B2 | 5/2014 | Nordlund | |
| 8,802,211 | B2 | 8/2014 | Cattacin et al. | |
| 8,857,614 | B2 | 10/2014 | Gordon | |
| 9,089,226 | B2 | 7/2015 | Kling | |
| 9,101,250 | B2 | 8/2015 | Ray | |
| 9,113,759 | B2 | 8/2015 | Ray et al. | |
| 9,380,917 | B2 | 7/2016 | Eilmus et al. | |
| D771,968 | S | 11/2016 | Bing et al. | |
| 9,499,369 | B2 | 11/2016 | Billman et al. | |
| 9,554,677 | B2 | 1/2017 | Cattacin et al. | |
| 2002/0056718 | A1* | 5/2002 | Paukov | A47K 10/3818 221/63 |
| 2002/0139828 | A1 | 10/2002 | Paukov | |
| 2003/0111480 | A1* | 6/2003 | Lewis | A47K 10/3818 221/44 |
| 2003/0164377 | A1 | 9/2003 | Budz et al. | |
| 2003/0194932 | A1 | 10/2003 | Clark et al. | |
| 2003/0215602 | A1 | 11/2003 | Andersson et al. | |
| 2004/0137815 | A1 | 7/2004 | Ellis et al. | |
| 2004/0228904 | A1 | 11/2004 | Ellis et al. | |
| 2005/0067424 | A1 | 3/2005 | Duff | |
| 2005/0067519 | A1 | 3/2005 | King | |
| 2005/0205594 | A1 | 9/2005 | Evans et al. | |
| 2005/0211715 | A1 | 9/2005 | Parris et al. | |
| 2005/0224628 | A1 | 10/2005 | Lewis et al. | |
| 2005/0236416 | A1 | 10/2005 | Reinke et al. | |
| 2006/0102642 | A1 | 5/2006 | Muntzing et al. | |
| 2006/0124680 | A1 | 6/2006 | Notarnicola | |
| 2006/0261076 | A1* | 11/2006 | Anderson | A47K 10/3818 221/33 |
| 2007/0199959 | A1* | 8/2007 | Getsy | B65D 47/265 222/480 |
| 2007/0231438 | A1 | 10/2007 | Repo | |
| 2008/0001017 | A1 | 1/2008 | Saarvali | |
| 2008/0061073 | A1 | 3/2008 | Laroche | |
| 2008/0073456 | A1 | 3/2008 | Goeking et al. | |
| 2008/0142520 | A1 | 6/2008 | Morgan | |
| 2008/0173661 | A1 | 7/2008 | Neveu | |
| 2008/0290210 | A1 | 11/2008 | Tramontina et al. | |
| 2009/0001212 | A1 | 1/2009 | Budz et al. | |
| 2009/0026306 | A1 | 1/2009 | Kempster et al. | |
| 2009/0039099 | A1 | 2/2009 | Friesen et al. | |
| 2009/0045211 | A1 | 2/2009 | Friesen et al. | |
| 2009/0114669 | A1 | 5/2009 | Decker et al. | |
| 2009/0120950 | A1 | 5/2009 | Titas et al. | |
| 2009/0120951 | A1 | 5/2009 | Titas et al. | |
| 2009/0212063 | A1 | 8/2009 | Cohen et al. | |
| 2009/0212149 | A1 | 8/2009 | Lan | |
| 2009/0223991 | A1 | 9/2009 | Lorenzati et al. | |
| 2009/0223992 | A1 | 9/2009 | Lorenzati et al. | |
| 2009/0223993 | A1 | 9/2009 | Lorenzati | |
| 2010/0078443 | A1 | 4/2010 | Hoefing et al. | |
| 2010/0117495 | A1 | 5/2010 | Cornell | |
| 2010/0176021 | A1 | 7/2010 | Gordon | |
| 2010/0187250 | A1 | 7/2010 | Kryshak | |
| 2010/0187251 | A1 | 7/2010 | Simmons | |
| 2010/0314485 | A1 | 12/2010 | Anderson | |
| 2011/0031265 | A1 | 2/2011 | Saarvali et al. | |
| 2011/0139807 | A1 | 6/2011 | Ray et al. | |
| 2012/0001014 | A1 | 1/2012 | Decker | |
| 2012/0037640 | A1 | 2/2012 | Thomas, Jr. et al. | |
| 2012/0053033 | A1 | 3/2012 | Sprick-Schuette et al. | |
| 2012/0097697 | A1 | 4/2012 | Gehring | |
| 2012/0104014 | A1 | 5/2012 | Hamer et al. | |
| 2012/0125795 | A1 | 5/2012 | Kullman et al. | |
| 2012/0163915 | A1 | 6/2012 | Hill | |
| 2012/0298689 | A1 | 11/2012 | Cohen | |
| 2013/0092705 | A1* | 4/2013 | Simmons | A47J 47/04 222/1 |
| 2013/0140340 | A1* | 6/2013 | Knapp | A47K 10/3818 225/46 |
| 2014/0096717 | A1 | 4/2014 | Springs | |
| 2014/0158810 | A1 | 6/2014 | Cattacin et al. | |
| 2014/0263387 | A1 | 9/2014 | Muehl et al. | |
| 2015/0004810 | A1 | 1/2015 | Song et al. | |
| 2015/0122937 | A1 | 5/2015 | Marietta-Tondin et al. | |
| 2016/0303002 | A1 | 10/2016 | Cunningham et al. | |

FOREIGN PATENT DOCUMENTS

| | | | |
|---|---|---|---|
| CN | 102621473 | A | 8/2012 |
| CN | 104627543 | A | 5/2015 |
| DE | 2222357 | A1 | 11/1973 |
| DE | 2818757 | A1 | 11/1979 |
| DE | 4006987 | A1 | 9/1991 |
| DE | 102014006220 | A1 | 11/2015 |
| DE | 102014006220 | B4 | 12/2015 |
| EP | 0107487 | A1 | 2/1984 |
| EP | 0128127 | A2 | 12/1984 |
| EP | 0550863 | A1 | 7/1993 |
| EP | 1289398 | B1 | 3/2003 |
| EP | 1317202 | B1 | 6/2003 |
| EP | 1333744 | A1 | 8/2003 |
| EP | 1366699 | B1 | 12/2003 |
| EP | 1401733 | B1 | 3/2004 |
| EP | 1881778 | A1 | 1/2008 |
| EP | 1938728 | B1 | 5/2008 |
| EP | 2394551 | A1 | 12/2011 |
| EP | 2448460 | B1 | 5/2012 |
| EP | 2648575 | A1 | 10/2013 |
| EP | 2941989 | B1 | 11/2015 |
| FR | 2667854 | A1 | 4/1992 |
| FR | 2669818 | A1 | 6/1992 |
| GB | 956622 | A | 4/1964 |
| GB | 1455216 | A | 11/1976 |
| GB | 1472366 | A | 5/1977 |
| GB | 2038778 | A | 7/1980 |
| GB | 2063213 | A | 6/1981 |
| GB | 2120639 | A | 12/1983 |
| GB | 2145693 | A | 4/1985 |
| GB | 2270299 | A | 3/1994 |
| JP | 5390323 | B2 | 1/2014 |
| KR | 100942323 | B1 | 2/2010 |
| MX | 289341 | | 6/2005 |
| MX | 327914 | | 6/2005 |
| RU | 2401044 | C2 | 10/2010 |
| WO | 00/02475 | | 1/2000 |
| WO | 02/38019 | A1 | 5/2002 |
| WO | 2005/005295 | A1 | 1/2005 |
| WO | 2006/098664 | A1 | 9/2006 |
| WO | 2006124429 | A1 | 11/2006 |
| WO | 2009/109723 | A1 | 9/2009 |
| WO | 2010/054063 | A1 | 5/2010 |
| WO | 2010/064961 | A1 | 6/2010 |
| WO | 2010/068590 | A1 | 6/2010 |
| WO | 2011/002361 | A1 | 1/2011 |
| WO | 2013/085493 | A1 | 6/2013 |
| WO | 2013/177100 | A2 | 11/2013 |
| WO | 2014/001999 | A2 | 1/2014 |
| WO | 2014/031048 | A1 | 2/2014 |
| WO | 2014/097077 | A1 | 6/2014 |
| WO | 2015/084880 | A1 | 6/2015 |
| WO | 2015166031 | A1 | 11/2015 |
| WO | 2016/018202 | A1 | 2/2016 |
| WO | 2016124848 | A1 | 8/2016 |

* cited by examiner

WEB MATERIAL CENTER-PULL DISPENSER ASSEMBLY

BACKGROUND OF THE INVENTION

The present application relates generally to towel or wipe dispensers, and more particularly, to an assembly and method of providing a pull-through towel dispenser assembly wherein the towel dispenses from a core of a bulk or source roll of towel paper web material.

Towel and wet wipes are commonly understood as sheets of a web of paper type material. Such towels and wipes can be provided in a number of configurations and provided as a dry wipe material or moistened with a fluid associated with the intended use of the discrete towel or wipes. Largely due to the convenience associated with their use, towels and wipes can be provided in various configurations associated with the intended use of the discrete web materials. Some such uses include cleaning parts of the human body, hand towels or wipes, use as toilet paper or baby wipes, degreasers, electronics cleaners, dust wipes, automotive applications including tire, leather, window, glass, and/or vinyl or plastic treatment, cleaning, and/or conditioning materials, etc. It is appreciated that the list provided above is in no way exhaustive or all-inclusive of the uses of such towels or wipes. It is further appreciated that the material and/or construction of the web material, as well as the material associated with moistening the towels or wipes, can be provided in a plethora of combinations associated with the intended use of the discrete towels or wipes for cleaning, sanitation, and/or surface or material conditioning treatments. It is further appreciated that, depending on the intended use of the discrete towels or wipes, such web materials can be provided in either of a non-moistened or dry configuration.

Whether provided in a wet or dry modality, such towels or wipes are occasionally provided in a disposable bag or canister that includes a dispensing structure that allows sequential extraction of one or more wipes when desired. The dispensing structure commonly includes a lid or other closure assembly that movably cooperates with a cover or bezel associated with the container. When provided to dispense wet or pre-moistened towels or wipes, the lid commonly provides a sealed interaction with the remainder of the container or cover to mitigate drying out of the wipes prior to use. Some towel or wet wipe containers are provided as disposable bags of wipes whereas other wipe dispensing containers are formed as selectively operable boxes or canisters that are configured to be re-useable and/or refillable. Such distribution or use approaches tend to produce substantial waste when deployed in heavy or frequent use environments.

Many such dispensers also include a wipe or towel separation structure defined by the cover or lid of the contained and that is configured to interact with the web material to effectuate sequential dispensing and/or separation between adjacent discrete units of the web material until the contents of the container are consumed. That is, many dispensing structures are constructed to cooperate with the web material of the towel or wipes so that at least an end portion of a subsequent towel or wipe is restrained by the separation structure in a manner such that the end of the subsequent towel or wipe can be grasped by the user but does not otherwise interfere with the desired opening and closing of the lid and a preferred sealed interaction between the lid and the remainder of the cover or container after each use of a discrete towel or wipe. Such approaches tend to increase manufacturing costs associated with formation of such dispenser assemblies and can detract from a desired sanitary operation of the dispensing container as each user interacts with the operable lid structures.

Unfortunately, many known personal use towel and wipe containers or dispensers are of relatively simple construction and the lids occasionally fail to provide desired separation between adjacent towels or wipes during the sequential use of the same. If left unaddressed, failure to adequately attend to the desired separation between the towels and wipes can result in undesirable waste of the towels or wipes due to the undesirable dispensing operation of the dispenser.

Many such personal use towel and wipe containers or dispensers suffer from additional drawbacks associated with use of the same. For instance, many such dispensers or containers are constructed to be easily transported and/or require two-handed interaction with the dispensing container to effectuate each dispensing event. Commonly, the user must grip, restrain, or otherwise secure the container or dispenser with one hand while extracting a desired number of towels or wipes. Whether provided as a personal supply or a bulk or multiple user supply of towels or wipes, if the restriction or separation mechanism fails to adequately effectuate the desired separation between adjacent towels or wipes, the user must interact with each of the adjacent wipes to effectuate the desired separation therebetween. Such operations detract from sanitary operation of the dispenser and can expose subsequent users to any materials associated with the prior user's interaction with the exposed or graspable portion of a subsequent towel or wipe.

Still further, many such towel or wipe dispenser assemblies are commonly constructed to effectuate sequential removal of towels or wipes from an exterior surface of the bulk source of towel or wipe web material. Such methodologies commonly employ a sequential folded interaction between adjacent wipes or must be configured to accommodate rotational support of a roll of web material such that the roll of bulk web material is consumed in a sequential manner from an exterior surface of the roll—a manner customary to dispensing of toilet tissue. Each methodology presents unique considerations to the manufacturer and proper presentation of the towels or wipes during the dispense operation and providing the desired separation between the adjacent towels or wipes when desired. Unfortunately, such approaches also operate in a dispense methodology wherein the exterior of most towels or wipes associated with the bulk source roll, the towels and wipes most susceptible to the undesirable effects of evaporation, are dispensed in a sequential manner Such approaches can result in excessive waste of the web material in that users tend to discard towels or wipes perceived to be insufficiently moist relative to previously used towels or wipes. Further exacerbating this shortcoming, each use of a desired towel or wipe or number of towels or wipes, leaves the next to be dispensed towel or wipe exposed to the conditions that resulted in drying out and/or ultimate waste of a preceding towel or wipe or wipes.

Accordingly, there is a need for a towel or wipe dispenser system or assembly that can support a bulk roll of web material and that is constructed to facilitate single handed interaction therewith. There is a further need for a web material dispenser assembly that accommodates a center-pull dispense methodology from the bulk source of web material. There is a further need for a web material towel or wipe dispenser system having an adjustable dispense assembly such that the dispenser assembly can be deployed with towels or wipes having different separation methodologies and/or various different dispense performance characteristics when dispensed in a center-pull manner There is a further need for a center-pull dispenser assembly having an adjustable dispensing aperture that can be secured in a desired orientation to mitigate nefarious interaction with the dispenser assembly.

SUMMARY OF THE INVENTION

The present application discloses a center pull-through web material dispenser assembly and method that overcomes one or more of the shortcomings disclosed above. One aspect of the present application discloses a dispenser assembly that includes a housing having a base and a moveable cover. A roll support is disposed in the housing and defines a portion of a material dispense passage. A restrictor plate is supported by the roll support and is rotatable and axially translatable relative to the roll support. The restrictor plate defines a number of dispense openings that can each be selectively aligned with the portion of the dispense passage defined by the roll support. Each of the discrete dispense openings defined by the restrictor plate have a size and/or shape that is different than a size and/or shape of the other discrete dispense openings such that the characteristics associated with the pull-through dispense activity of the dispenser assembly can be quickly and conveniently configured to achieve a desired dispense action.

Another aspect of the present application that is useable or combinable with one or more of the above features or aspects discloses a pull-through web material dispenser assembly having a housing that defines a cavity shaped to receive a roll of web material. A platform is disposed in the housing and shaped to support an end of a roll of web material disposed in the housing. A passage is formed through the platform and has a frustoconical shape such that a cross-sectional area of the passage reduces as the passage progresses away from the cavity toward atmosphere. A dispense plate is attached to the platform such that the dispense plate is rotatable relative to the platform. A plurality of openings are formed through the dispense plate and each of the plurality of openings is oriented relative to the dispense plate and an axis of rotation of the dispense plate such that each of the plurality of openings can be independently selectively aligned with the passage formed through the platform. Such a construction allows the web material dispenser assembly to be quickly and conveniently configured to provide the desired separation between adjacent towels or wipes when dispensed in a pull-through manner.

Another aspect of the present application that includes various aspects or features that can be combined or are usable with various features or aspects of the apparatuses disclosed above includes a center pull-through towel dispenser assembly that includes a base and a cover that is connected to the base and movable between an open position and a closed position. A roll support extends in a generally horizontal direction between the base and the cover and a passage is formed through the roll support. The passage is defined by an inlet having an oblong cross-section shape and an outlet that is offset in a radial direction toward an edge of the roll support. A restrictor plate is rotationally connected to the roll support and a plurality of restrictor holes are formed through the restrictor plate. Each of the restrictor holes is offset in a radial direction from an axis of rotation of the restrictor plate relative to the roll support and oriented to be selectively axially aligned with the outlet of the passage formed through the roll support.

A further aspect of the present application that is usable or combinable with one or more of the aspects or features of the assemblies disclosed above includes a method of forming a pull-through dispenser assembly that includes providing a housing having a base and a cover that is moveably connected to the base so the housing is configured to provide an open configuration and a closed configuration. A support plate is provided that cooperates with the housing and is oriented to support a roll of web material in a vertical orientation. An opening is formed through the support plate and shaped to have an oblong inlet that extends in a radial direction across a portion of the support plate. A restrictor is provided that has a plurality of dispense openings and is configured to be supported by the support plate. The restrictor is supported relative to the support plate such that each of the plurality of dispense openings formed in the restrictor can be selectively axially aligned with an outlet of the opening formed through the support plate.

Yet another aspect of the present application that is combinable or usable with one or more the aspects or features of the methods and apparatuses disclosed above includes a method of adjusting a dispense passage defined by a center pull-through towel dispenser assembly. The method includes axially translating an orifice plate that has a plurality of discrete dispense orifices relative to a roll support plate that has a fixed shape dispense opening. Once translated, orifice plate can be rotated relative to the roll support plate until a desired one of the plurality of dispense orifices is axially aligned with the single dispense passage defined by the roll support plate. Releasing the orifice plate allows the orifice plate to translate in an opposite axial direction to a position wherein the orifice plate is non-rotatable relative to the roll support plate.

A dispenser assembly and method of providing a web material dispenser assembly that is configured to dispense web material in a pull-through manner from a core of a roll of web material. The dispenser assembly includes a housing having a base and a moveable cover. A roll support is disposed in the housing and defines a portion of a material dispense passage. A restrictor plate is supported by the roll support and is rotatable and axially translatable relative thereto. The restrictor plate defines a number of dispense openings that can be selectively aligned with the portion of the dispense passage defined by the roll support such that the characteristics associated with the pull-through dispense activity of the dispenser assembly can be quickly and conveniently configured to achieve a desired dispense action.

These and various other aspects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
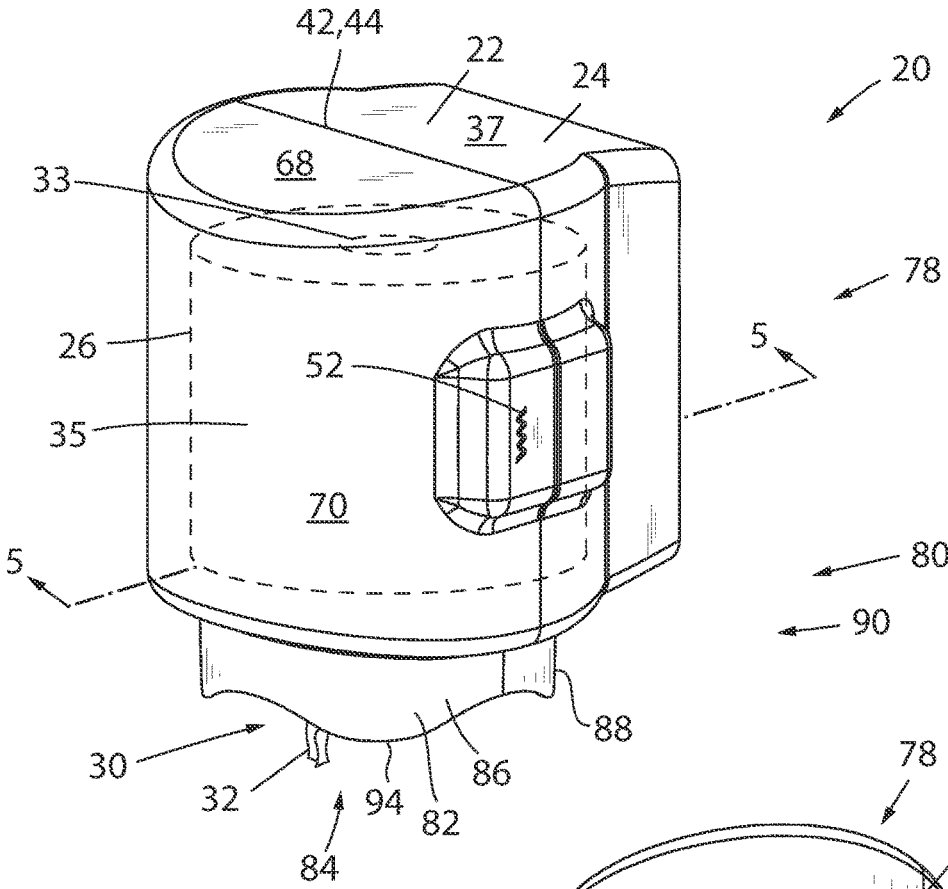
FIG. 1 is a front upper right side perspective view of a web material towel or wipe dispenser assembly according to the present application.

Before explaining the invention in detail below with respect to the preferred embodiment as shown in the drawings, it is to be understood that the invention is not limited in its application to the details of construction and the arrangement of the components set forth in the following description or illustrated in the drawings. It is appreciated that the invention is capable of other embodiments or being practiced or carried out in various ways. Also, it is to be understood that the phraseology and terminology employed herein is for the purpose of description and should not be regarded as nor is it intended to be limiting.

DETAILED DESCRIPTION OF THE PREFERRED EMBODIMENTS

In describing the preferred embodiment of the invention as illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. The various features and advantageous details of the subject matter disclosed herein are explained more fully with reference to the non-limiting embodiments described in detail in the following description.

Figure 2:
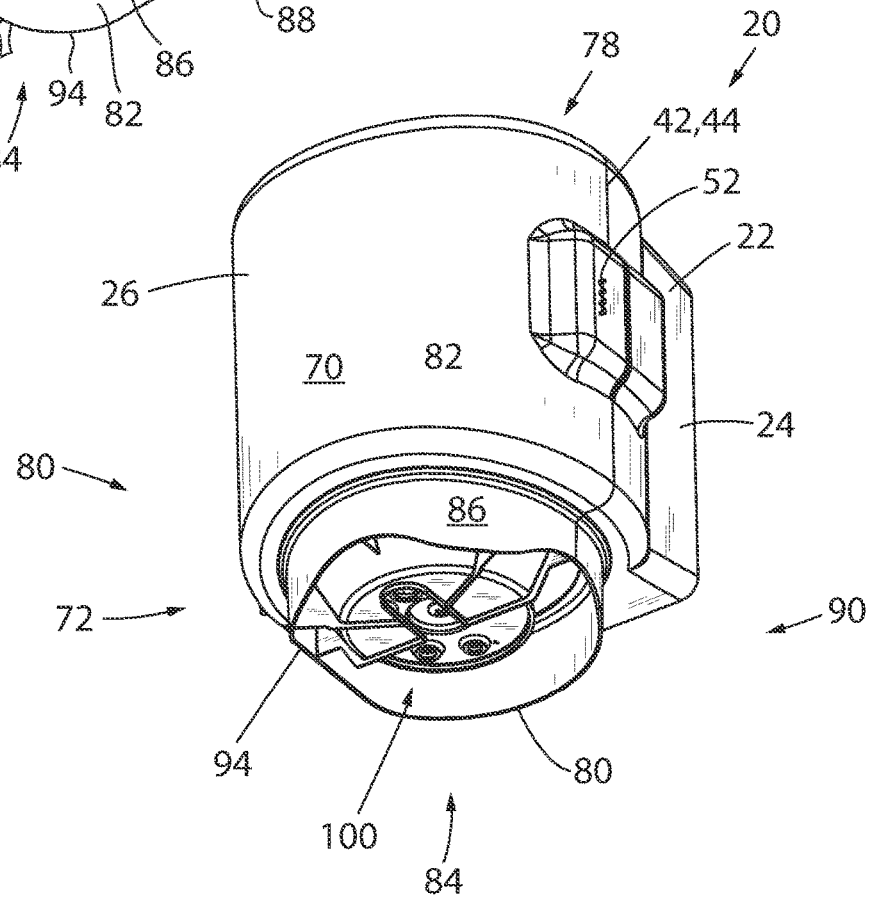
FIG. 2 is front lower right side perspective view of the dispenser assembly shown in FIG. 1.
Figure 3:
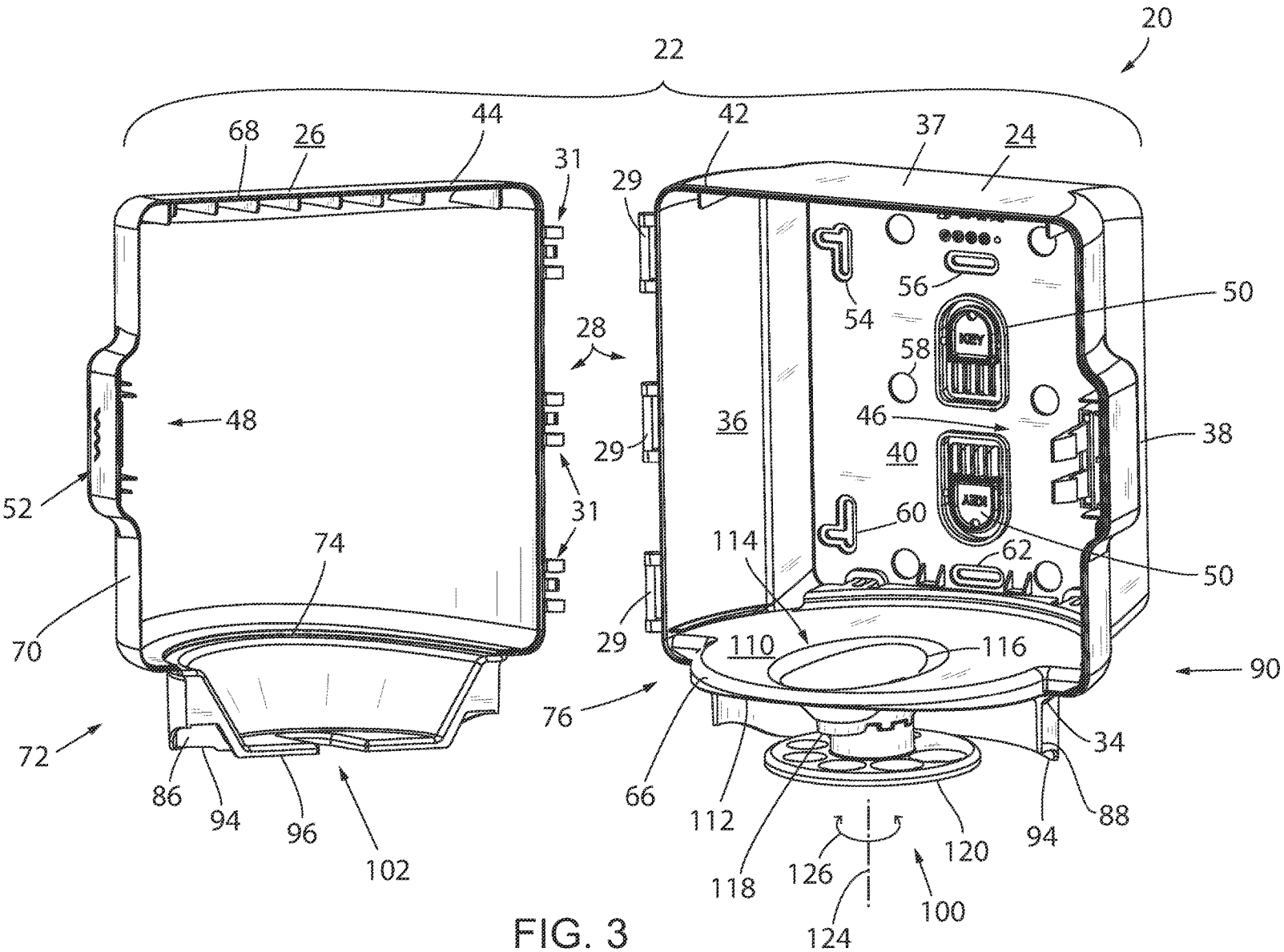
FIG. 3 is a view similar to FIG. 1 of the dispenser assembly shown therein and shows a cover rotated toward an open position and exploded from a base of the assembly.

FIGS. 1-7 show various views of a web material towel or wipe dispenser, wipe dispenser, dispenser, towel dispenser, or more generally dispenser assembly 20 according to a preferred embodiment of the present invention. Referring to FIGS. 1-3, dispenser assembly 20 includes a housing 22 that is generally defined by a base 24 and a cover 26 that movably, and preferably pivotably, cooperate with one another to selectively expose a cavity 28 defined by housing 22. Base 24 preferably includes one or more bosses 29 and cover 26 preferably includes one or more tangs 31 that are each constructed and oriented to selectively cooperate with a respective boss 29 to define a vertically oriented axis of rotation of cover 26 relative to base 24. It is further appreciated that base 24 and cover 26 can be constructed to include a more conventional hinge assembly, such as hinges including one or more barrel portions and corresponding hinge pins or the like, to facilitate the rotational cooperation between cover 26 and base 24.

As disclosed further below, cavity 28 is shaped to accommodate and support a bulk roll 35 of web towel or wipe material 30 (FIG. 1) in a substantially vertical orientation such that the web material 30 can be sequentially dispensed from dispenser assembly 20 in a center pull-through manner via manual extraction of a terminal end 32 of the roll of web material 30 that emanates from a core 33 of the bulk roll 35 (shown in phantom in FIG. 1) and beyond the confines of the volume bounded by housing 22 of dispenser assembly 20. As disclosed further below, dispenser assembly 20 includes a plurality of fixed shaped dispense openings that are moveable relative to housing 22 to facilitate selective use each of the fixed shape dispense openings to provide a desired dispense performance and to mitigate roping or extraction of more than a desired discrete towel or wipe of web material without the desired separation between desired discrete portions of the bulk web material as disclosed further below.

Base 24 includes a top wall 37, a lower wall 34, and opposing sidewalls 36, 38 that each extend from a rear wall 40. A forward facing edge 42 of base 24 has a shape that generally corresponds to a base facing edge 44 of cover 26. At least an upward oriented portion of forward facing edge 42 of base 24 optionally preferably sealingly cooperates with an upward oriented portion of base facing edge 44 of cover 26 when housing 22 is oriented in a closed orientation. A latch 46 is supported by base 24 and is shaped to selectively cooperate with a catch 48 defined by cover 26. One or more keys 50 are supported by rear wall 40 in a knock-out manner such that keys 50 can be selectively be removed from rear wall 40 when desired. Keys 50 are shaped to selectively cooperate with a keyhole 52 defined by cover 26 to manipulate the interaction between latch 46 and catch 48 to allow opening and closing of housing 22 and limit access to cavity 28 by only authorized personnel. One or more openings 54, 56, 58, 60, 62 are formed through rear wall 40 of base 24 and constructed to facilitate securing housing 22 relative to a support structure such as a wall or the like.

As disclosed further below, dispenser assembly 20 includes a guide, a roll support, a platform, a roll support plate, or a support assembly 66 that is preferably constructed to snap-fittingly cooperate with base 24 and oriented to support a bulk roll 35 of web material 30 placed thereupon when dispenser assembly 20 is deployed in a vertically upward directed orientation wherein the dispense opening is oriented to face in a generally downward vertical direction as reflected by the orientation shown in FIG. 1. As disclosed further below, it is envisioned that dispenser assembly 20 can be deployed in an opposing or inverse vertical orientation such that support assembly 66 functions more so as a guide associated with the center core pull dispensing event as compared to a structure associated with supporting the bulk of the load associated with the roll of web material as is provided by support assembly 26 when the dispenser assembly 20 is deployed in an upright vertical orientation as represented by the orientation of dispenser assembly 20 shown in FIG. 1.

Cover 26 includes a top wall 68 and a generally arcuate shaped sidewall 70 that is bounded by base facing edge 44 of cover 26. When deployed in an upright orientation, top wall 37 of base 24 and top wall 68 of cover 26 are oriented at a vertical uppermost position relative to the remainder of dispenser assembly 20. When deployed in an inverse or inverted orientation, top wall 37 of base 24 and top wall 68 of cover 26 are oriented at a vertical lowermost position relative to the remainder of dispenser assembly 20. It should be appreciated that a generally downward or radially outward directed extraction event is associated with upright positioning of dispenser assembly 20 and an upward or radially outward directed extraction event is associated with the inverted or upwardly directed orientation of the dispense passage when dispenser assembly is oriented such that top wall 37 of base 24 and top wall 68 of cover 26 are oriented in a generally downward facing direction relative to the remainder of the structure of housing 22. The remainder of the directional references, such as "upper", "lower", etc., provided hereafter will be provided relative to the upright orientation of dispenser assembly wherein top walls 37 and 68 are oriented in a vertically upward directed orientation as shown in FIG. 1 simply for continuity.

A lower portion 72 of cover 26 includes a recess 74 that is shape to cooperate with a forward facing edge 76 of support assembly 66 when cover 26 is oriented in a closed orientation 78 (FIGS. 1 and 2) relative to base 24. Roll support assembly 66 is constructed and shaped to support the bulk roll 35 such that cover 26 is free to translate between the open and closed orientations without manipulating a position of the bulk roll 35, or remaining portions thereof, relative to base 24 and support assembly 66 during loading or service operations of assembly 20 when dispenser assembly 20 is oriented in the upright orientation shown in FIG. 1. Such a consideration allows single or two handed manipulation of the bulk roll 35 during loading and threading operations associated with operation or use of assembly 20 in the first or upright vertical orientation as disclosed further below.

A lower portion 80 of dispenser assembly 20 includes a shroud 82 that extends generally circumferentially about a dispense area 84 of housing 22. Shroud 82 includes a first portion 86 that is defined by lower portion 72 of cover 26 and a second portion 88 that is generally defined by a lower portion 90 of base 24. Shroud 82 includes a lower edge 94 having one or more cutouts or a generally curvilinear shape that accommodates visual inspection of terminal end 32 of web material 30 during use of dispenser assembly 20 from one or more angles of approach to dispenser assembly 20 and whether dispenser assembly 20 is deployed in the upright or inverted vertical orientations.

Lower portion 72 of cover 26 includes a support, a partition, a stop, or a guard 96 that is configured to selectively interfere with operation or manipulation of an adjustable dispense assembly 100 supported by base 24. Guard 96 includes a channel 102 that is shaped to be generally aligned with the longitudinal axis associated with terminal end 32 of web material 30 during use of dispenser assembly 20. That is, channel 102 optionally defines a portion of the dispense passage associated with the sequential extraction of web material 30 in the pull-through manner during use of dispenser assembly 20. Alternatively, guard 96 could be provided with a generally arcuate terminal end that is shaped to obstruct axial translation of dispense assembly 100 with a deminimis contribution to the definition of the dispense passage.

Figure 4:
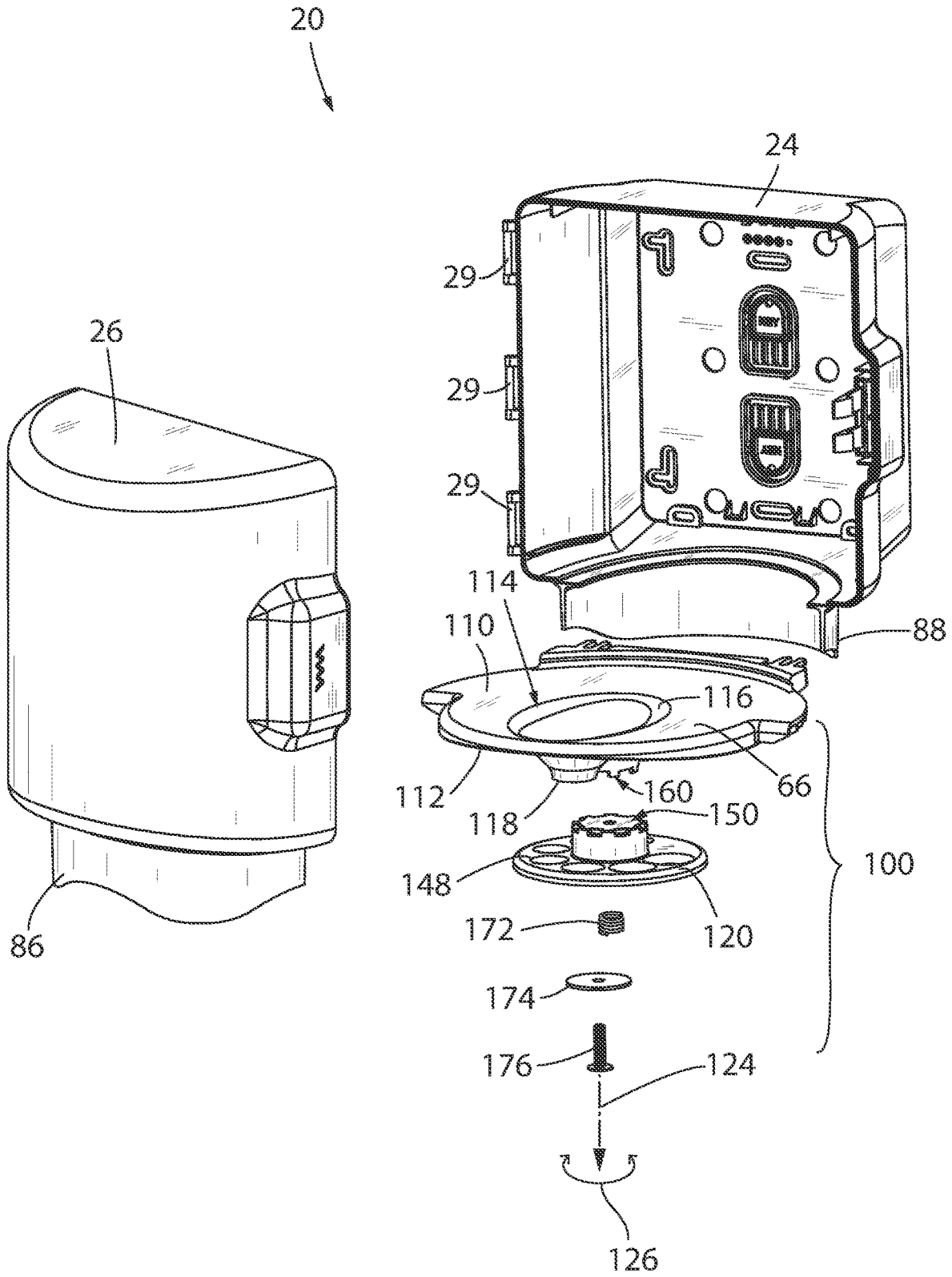
FIG. 4 is an exploded perspective view of the dispenser assembly shown in FIG. 1.

Referring to FIGS. 3 and 4, roll support assembly 66 includes a cavity facing or upper surface 110 and an atmosphere or restrictor plate facing lower surface 112. A portion of the web material dispense passage is defined by a dispense opening or passage 114 that is formed through roll support 66 and oriented to extend uninterrupted from upper surface 110 to lower surface 112. Passage 114 includes an inlet 116 and an outlet 118 that are oriented to fluidly connect cavity 28 to the atmosphere about dispenser assembly 20. A dispense plate, restrictor, orifice plate, or restrictor plate 120 is connected to roll support assembly 66 and is movable in an axial direction, indicated by arrow 124, and a rotational direction, indicated by arrow 126, to manipulate a cross sectional area of a portion of the dispense passage associated with extraction of the web material from the dispenser assembly 20, and thereby, the dispenser performance thereof. Preferably, axis 124 is aligned with but offset from an axis defined by the rotational operation between bosses 29 and tangs associated with the rotational cooperation between base 24 and cover 26.

Figure 5:
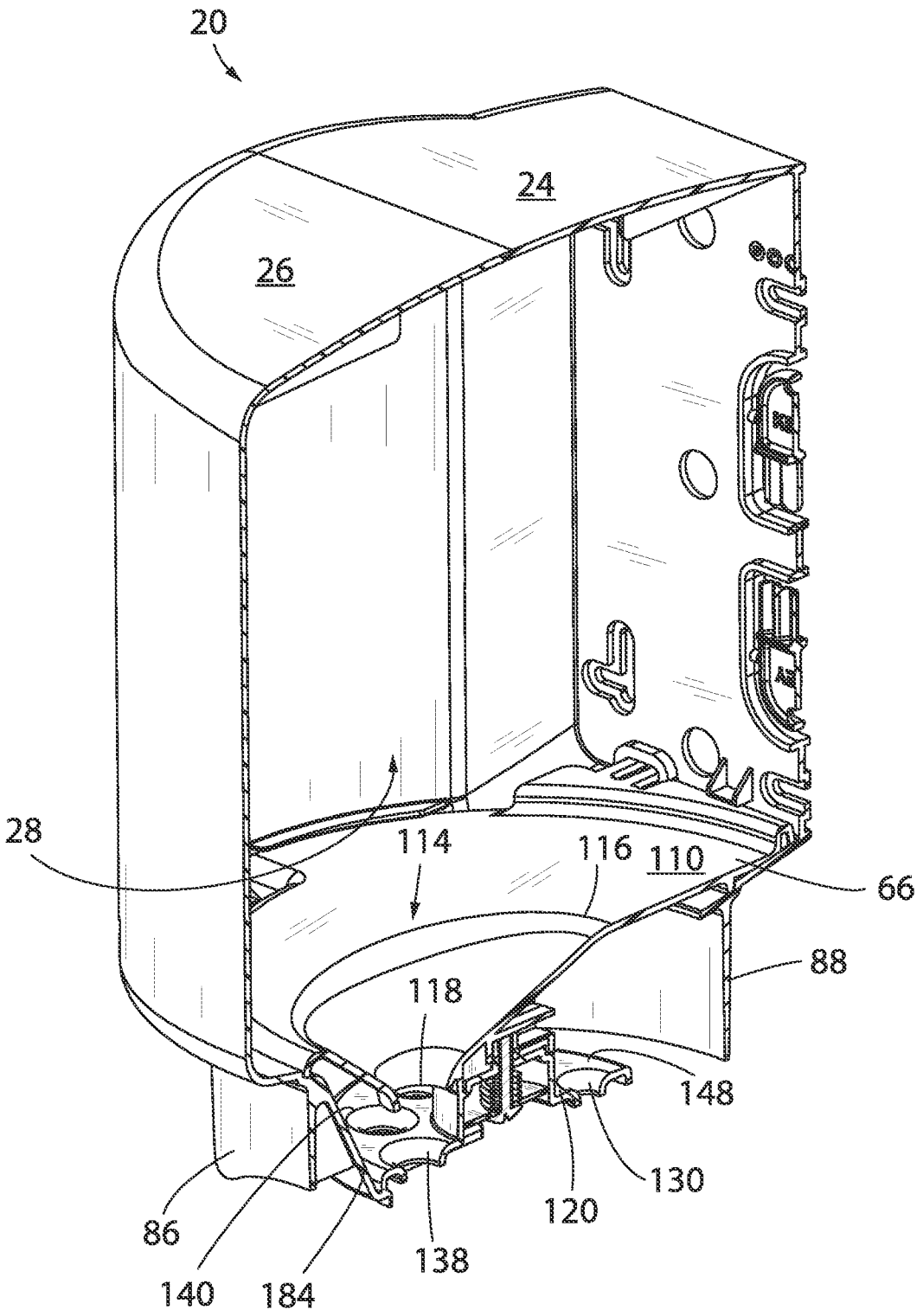
FIG. 5 is a perspective view of an elevational cross section of the dispenser assembly taken along line 5-5 shown in FIG. 1.
Figure 6:
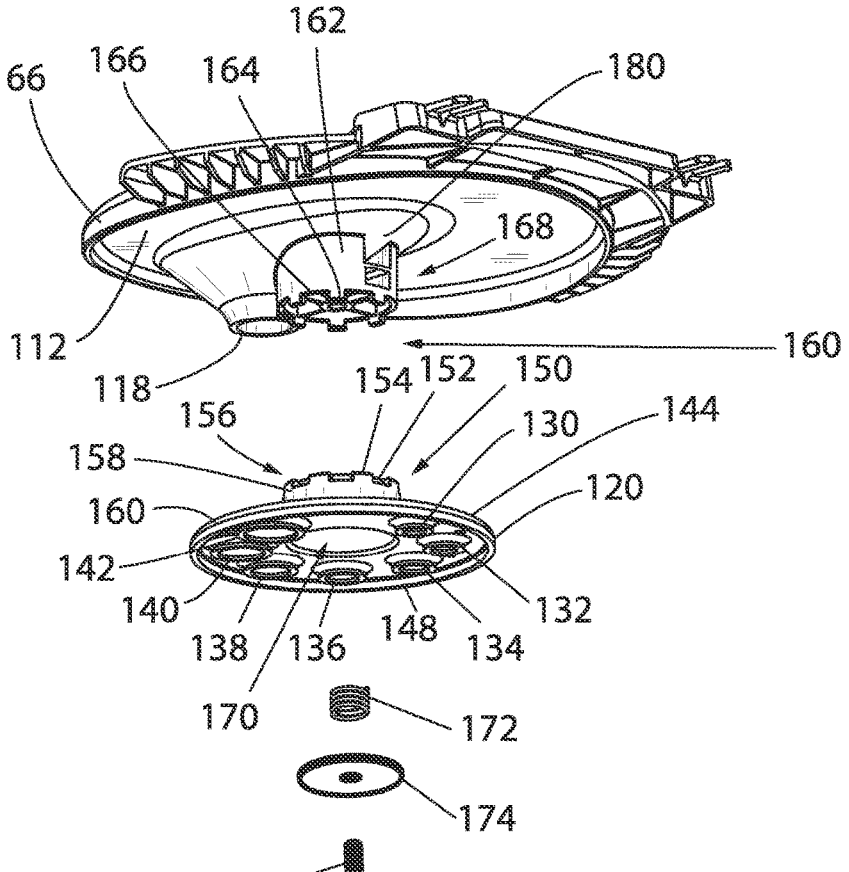
FIG. 6 is a rear lower right side exploded perspective view of an adjustable restriction passage assembly of the dispenser assembly shown in FIG. 2.

As disclosed further below, manipulation of restrictor plate 120 relative to support assembly 66 manipulates the configuration or shape associated with a portion of the dispense passage attributable to restriction plate 120 and associated with extracting the towel or wipe web material from dispenser assembly 20 during the pull-through activity. Referring to FIGS. 4-6, restrictor plate 120 includes a plurality of openings 130, 132, 134, 136, 138, 140, 142 that are each positioned radially inward relative to a perimeter 144 of restrictor plate 120 and radially outward relative to axis of rotation 124 of restrictor plate 120. Each opening 130-142 is circumferentially bounded by a body 148 of restrictor plate 120 and preferably defined by discrete respective central axes that are offset a uniform distance 151 (FIG. 7) from axis 124. Such a construction ensures that each of openings 130-142 can be generally centrally aligned with outlet 118 associated with passage 114 defined by support assembly 66 when each discrete opening 130-142 is aligned with passage 114.

Each of openings 130-142 are sized and shaped to facilitate passage of towel or wipe web material therethrough in a manner that effectuates passage of a next to be dispensed web material partially through the respective opening and in a manner that effectuates separation between adjacent discrete towels or wipes at a desired location associated with the extraction of the web material from the radial core 33 of the bulk roll 35 of web material 30. It should be appreciated that the web material is preferably intermittently partially perforated to effectuate the desired separation during extraction of the towels or wipes of web material during extraction from housing 22 while progressing the terminal end 32 of a subsequent towel or wipe, i.e. the end opposite the discrete perforation, to present through the respective opening 130-142 and to be positioned to be grasped for a subsequent dispense event.

It is further appreciated that the web materials, whether considered as towels or wipes, may be presented in dry or treated with cleaning or treatment fluids or solutions and/or prepared with different woven material thicknesses or weights depending on manufacturer preferences or the intended use of the discrete towels and/or wipes. Dispenser assembly 20 is constructed to accommodate dispensing of woven web materials having various dispense characteristics as a function of the construction and/or composition of the discrete towels or wipes and/or the formation of the discrete bulk roll 35. The constricting operation associated with the interaction of the web material 30 with the discrete opening 130-42, when properly selected, facilitates single-handed dispensing interaction with dispenser assembly and the ability of dispenser assembly 20 to be configured for single handled operation with web materials have varied constructions and in a manner that provides the desired separation between adjacent towels of the bulk roll without excessive roping of the towel web material during each discrete dispense event.

Restrictor plate 120 includes an interference engagement in the form of a toothed interface 150 that is defined by a plurality of discrete recesses 152 and projections 154 that extend about a circumference 156 of a post 158 that extends from a support plate facing surface 161 of restrictor plate 120. Toothed interface 150 of restrictor plate 120 is constructed to operatively cooperate with an interference engagement or toothed interface 160 associated with a post 162 extending from lower surface 112 of roll support assembly 66. Toothed interface 160 includes a number of projections 164 that are each separated from one another by respective recesses 166 and oriented to extend about a circumference 168 of post 162. Toothed interface 150 and toothed interface 160 mesh with one another so as to provide selective rotational cooperation between restrictor plate 120 and roll support 66 when desired. That is, when engaged with one another, toothed interfaces 150, 160 prevent rotation of restrictor plate 120 relative to roll support 66 and thereby prevent rotation of restrictor plate 120 relative to dispenser assembly 20 either by the user or inadvertently during the discrete dispense events.

Figure 7:
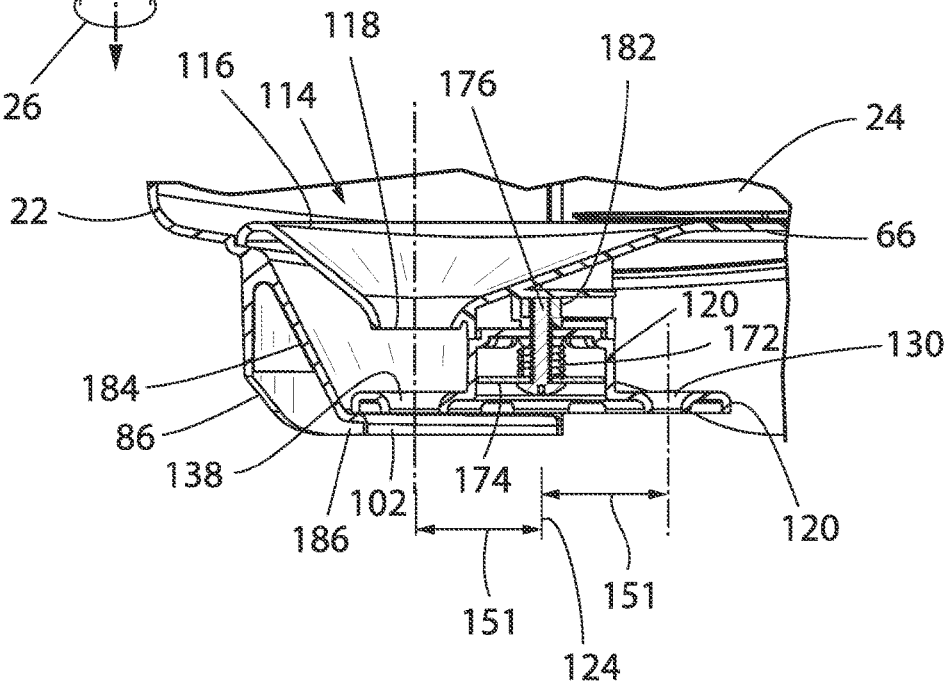
FIG. 7 is a side elevation cross section view of the assembled adjustable restriction passage assembly associated with the base and the cover of the dispenser assembly shown in FIG. 1 along line 5-5 and when the housing is oriented in the closed configuration.
Figure 8:
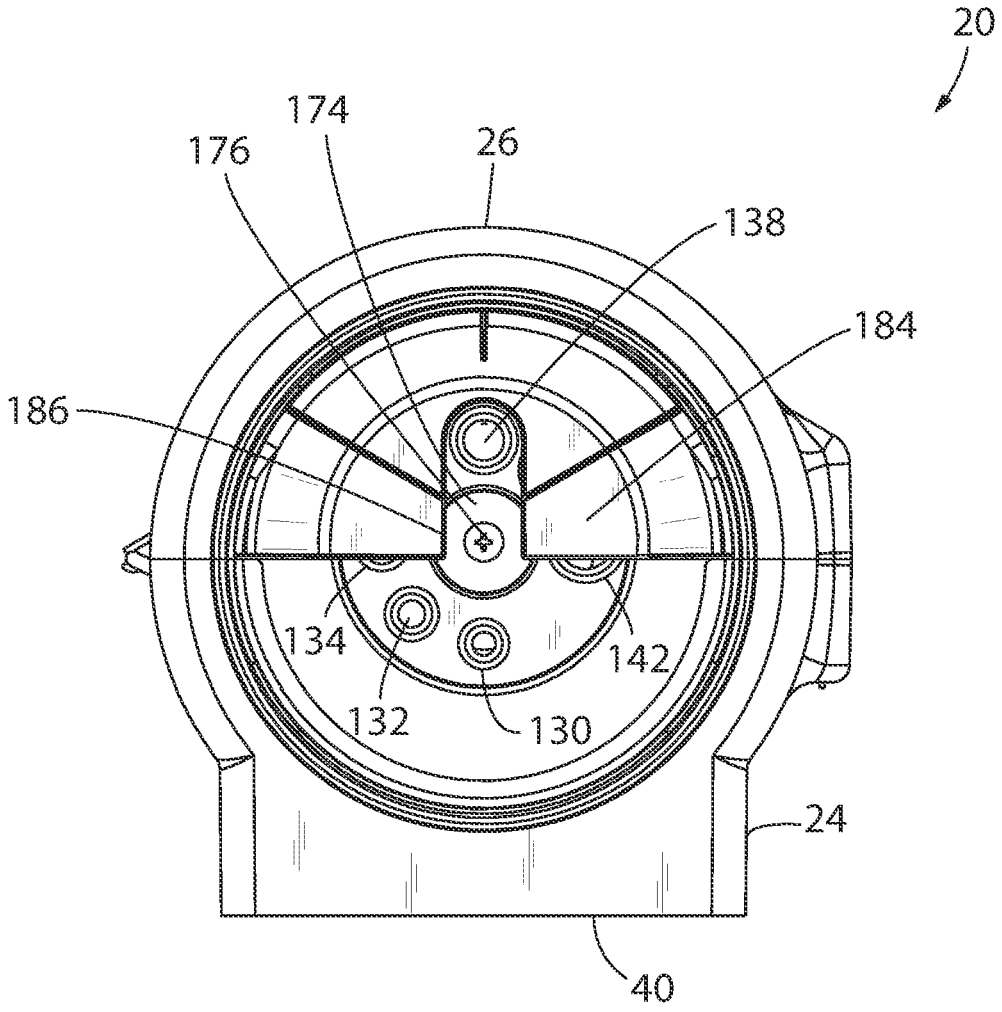
FIG. 8 is a bottom plan view of the dispenser assembly shown in FIG. 1.

Referring to FIGS. 6-8, downward facing surface of restrictor plate 120 includes a cavity 170 that is shaped to accommodate a biasing device, such as a spring or the like 172, a cap plate 174, and passage of a portion of a fastener 176 therethrough. A cavity 180 (FIG. 6) is formed in a portion of roll support assembly 66 and is shaped to receive a securing device, such as a nut 182 or the like, that is constructed to cooperate with fastener 176 when restrictor plate 120 is secured to support assembly 66. Referring to FIGS. 6 and 7, fastener 176 and biasing device 172 are constructed to cooperate with restrictor plate 120 and support assembly 66 such that restrictor plate 120 is biased toward support assembly 66 and the toothed interfaces 150, 160 operatively cooperate with one another to prevent rotation of restrictor plate 120 relative to support assembly 66.

Referring to FIGS. 5, 7, and 8, a portion of guard 96 defined by cover 26 forms a stop 184 that extends in a generally inward radial direction relative to first portion 86 of shroud 82 associated with cover 26. When cover 26 is oriented in the closed orientation relative to base 24, a distal end 186 of guard 96 associated with stop 184 formed proximate channel 102 prevents axial translation of restrictor plate 120 relative to support assembly 66. Opening of cover 26 relative to base 24 translates stop 184 out of interference with restrictor plate 120 such that, when housing 22 is oriented in an open configuration, the user can interact with restrictor plate 120 to effectuate axial displacement of restrictor plate 120 in a downward or outward direction relative to support assembly 66 such that toothed interfaces 150, 160 disengage one another. When toothed interfaces 150, 160 are disengaged from one another, restrictor plate 120 can rotate about axis 124, as indicated by arrow 126, to orient the desired discrete one of passages or openings 130, 132, 134, 136, 138, 140, 142 relative to the outlet 118 defined by support assembly 66.

Interfaces 150, 160 are each constructed such that the discrete projections or teeth 154, 164 and corresponding respective cavities or recesses 152, 166 mesh and thereby prevent rotation of restrictor plate 120 relative to support assembly 66 and such that the discrete axes associated with the cross-sectional continuous perimeters associated with each of the discrete openings 130-142 are preferably centrally disposed relative to the axis defined by outlet 118 associated with passage 114 of support assembly 66. Such a construction ensures the desired axial alignment of each discrete opening 130-142 with passage 114 defined by support plate 66 when desired to achieve the desired center pull-through web material dispensing performance.

Referring to FIGS. 5 and 7, passage 114 defined by support assembly 66 has a downwardly directed generally frustoconical shape that is defined by a larger cross-sectional area associated with inlet 116 and which cross-sectional area gradually reduces to a smaller cross-sectional area associated with outlet 118 of passage 114. The cross-sectional shape of inlet 116 of passage 114 has an oblong shape reflected by a major and a minor axis of the cross section of inlet 116. The cross-sectional shape of passage 114 progresses from the oblong shape associated with inlet 116 to a more uniform symmetrical shape of passage 114 proximate outlet 118. Passage 114 defines a constriction that is shaped to rope or guide distal or terminal end 32 of a discrete towel or wipe web material 30 from the core 33 of bulk roll 35 to the outlet 118 defined by support assembly 66 and therefrom through a discrete opening 130-142 associated with restrictor plate 120 that is aligned with outlet 118 defined by passage 114 and has a desired cross-sectional area. Referring to FIGS. 5 and 7, it should be appreciated that opening 138 defined by restrictor plate 120 is oriented to be the discrete dispense opening when restrictor plate 120 is oriented in the relative rotational position shown in FIGS. 5 and 7—whether dispenser assembly 20 is oriented in an upright or inverted orientation.

It should be further appreciated that opening of cover 26 of housing 22 translates stop 184 to a position that is offset from restrictor plate 120 such that, when housing 22 is open, a user can translate restrictor plate 120 in a generally downward or generally axially away from support assembly 66, and against the bias provided by spring 172, to effectuate disengagement of the interference engagements defined by toothed interfaces 150, 160 and subsequent rotation of restrictor plate 120 relative to roll support assembly 66 until a discrete or desired one of openings 130-142 is oriented in alignment with outlet 118 of support assembly 66.

Preferably, toothed interfaces 150, 160 are configured to engage or mesh with one another in a manner that inhibits rotation of restrictor plate 120 relative to support assembly 66 only when one of discrete openings 130-142 is axially aligned with the outlet 118 defined by passage 114. Such a consideration would mitigate the user's ability to unintentionally "misalign" relative to the axial alignment of a desired opening 130-142 relative to passage 114 but could also detract from the adjustability of restrictor plate 120 relative to support assembly 66 for those web materials wherein a degree of "misalignment" of the openings 130-142 relative to the axis of passage 114 may be desired to achieve a desired web material towel dispensing and separation performance.

In a preferred configuration, upon positioning of a desired one of openings 130-142 in the desired alignment with outlet 118, releasing restrictor plate 120 allows toothed interfaces 150, 160 to re-associate with one another and to define the general rotational orientation of restrictor plate 120 relative to support assembly 66 with the desired opening 130-142 restrained in the aligned orientation relative to outlet 118 of support assembly 66. Such a construction allows the user to quickly and conveniently manipulate the output dispense performance associated with passage 114, roll support assembly 66, and restrictor plate 122 and to manipulate the dispense performance associated with use of dispenser assembly 20. That is, openings 130-142 are shaped to facilitate the discrete incremental dispensing of web material from the core 33 of the bulk roll 35 source thereof and in a guided and constricting manner that allows and/or facilitates single-handed dispense activity with separation between adjacent towels or wipes associated with portions of the bull roll of web material and to achieve the desired separation between adjacent discrete towels or wipes at desired lines of perforation associated therewith during a dispense activity.

Preferably, when the user subjects terminal end 32 of web material 30 to a generally downward directed pulling load, discrete selected opening 130-142 associated with restrictor plate 120 provides a resistance to the downward directed pulling load and a resistance that is sufficient to effectuate the desired separation between adjacent towels, wipes, or portions of the bulk roll 35 of web material 30 during each extraction event and in a manner that presents a terminal end 32 of the next subsequent towel of web material at a grippable outboard location proximate restrictor plate 120. For instance, upon loading, if desired repeatable separation between adjacent towels does not occur, passing the terminal end 32 of the web material 30 through the next smallest bounded opening 130-142 defined by restrictor plate 120 will alter the separation performance between adjacent towels or wipes of the web material being dispensed.

Similarly, if too much force is required to effectuate each extraction event, passing the terminal end 32 of web material 30 through the next largest opening 130-142 will reduce the force associated with the pull-through extraction event and will also manipulate the discrete towel or wipe separation performance provided by dispenser assembly 20. Such considerations allow the user to individualize the use of dispenser assembly 20 to provide the desired dispense performance for web materials having various dispense performance characteristics due to the nature of the varied construction of the discrete bulk web material constructions associated with sourcing web material 30 and the core dispensing performance of such bulk materials.

As alluded to above, it is appreciated that dispenser assembly 20 can be deployed in an upright vertical orientation or an inverted vertical orientation and is configured to dispense, in a pull-through manner, towel or wipe web materials from a core of a bulk roll of web material. When deployed in the inverted vertical orientation, it is appreciated that housing 22 is shaped to accommodate a bulk roll of web material that could be supported by the surfaces of top wall 37 and top wall 68 of housing 22 that face cavity 28. Alternatively, it is appreciated that housing 22 could be constructed to cooperate with a supplemental support plate having a construction generally similar to support assembly 66 but without a passage formed therethrough.

It should be appreciated that such a support plate has a perimeter circumferential shape generally similar to assembly 66 and could preferable be constructed to snap-fittingly cooperate with base 24 in a manner similar to roll support assembly 66 but at a location proximate the cavity 28 facing sides of walls 37, 68. When deployed in an inverted orientation, such a supplemental plate would support the bulk roll of web material placed in cavity 28. Alternatively, base 24 and cover 26 are constructed such that a bulk roll of web material 30 can cooperate with the interior surfaces of walls 37, 68 when disposed in cavity 28 such that the center of gravity of the bulk roll 35 is located toward the base facing side of the plane defined by the interface of edges 42, 44 of base 24 and cover 26. Such a consideration allows self-supported position of a bulk roll of web material during loading operations and in a manner that allows two handed interaction by the user with the terminal end 32 of the roll of web material to effectuate adjustment of restrictor plate 120 when necessary and the threading of the terminal end 32 of the towel web material through passage 114 and subsequently through the selected or desired one of openings 130-142 during the initial web material loading operation.

Once loaded and the terminal end of the web material is threaded through the passage 114 of support plate assembly 66—which rests generally above the bulk roll of web material; and the desired opening 130-142 of restrictor plate 120, dispenser assembly operates and functions in the same manner as disclosed above. One distinct advantage to the inverted orientation of the dispenser assembly is that the bulk roll of web material 35 can be associated with cavity 28 and provided in a moistened configuration or contained in a plastic bag or the like such that the bulk web material can be maintained in a moistened or wet condition throughout the incremental consumption or usage of the entire or proximate the entire bulk roll of web material during a normal period of use.

The inverted orientation of the dispenser assembly and the containment of a volume of fluid therein allows use of dispenser assembly 20 to dispense pre-moistened web material towels or wipes from a core of a bulk roll of such material and in an orientation wherein any excess moisture associated with the discrete towels or wipes is communicated to the bulk source of web material during each extraction event and via the rope of web material progressing from the core of the bulk roll. Such considerations enhance the applicability and fields of use associated with dispenser assembly 20 and mitigate the costs associated with the manufacture of more personal use volumes of pre-moistened towels and wipes. Further, upon consumption or usage of a bulk roll of web material, any residual moistening agent can be conveniently communicated to the next bulk roll of web material associated with the dispenser assuming similar moisture agents exist between a consumed roll and a subsequent roll of bulk web material. Such concerns further mitigate production of waste associated with incremental dispensing of towel and wipe web materials from bulk sources.

Therefore, one embodiment of the application includes a pull-through web material dispenser assembly having a housing that defines a cavity that is shaped to receive a roll of web material. A platform is disposed in the housing and is shaped to support an end of the roll of web material received in the housing. A passage is formed through the platform and has a frustoconical shape such that a cross-sectional area of the passage reduces as the passage progresses away from the cavity toward atmosphere. A dispense plate is attached to the platform such that the dispense plate is rotatable relative to the platform. A plurality of openings are formed through the dispense plate, each of the plurality of openings is oriented relative to the dispense plate and an axis of rotation of the dispense plate such that each of the plurality of openings can be aligned with the passage formed through the platform. Such a construction defines a dispenser assembly that can be used to sequentially dispense web materials from bulk roll sources and in a manner that provides an adjustable pressure associated with the pull-through activity to provide a desired separation between the discrete towels or wipes associated with the bulk source.

Another embodiment of the present application that includes various features and aspects combinable with one or more of the embodiments, features, or aspects disclosed above includes a center pull-through towel dispenser assembly that include a cover that is connected to a base and that is movable between an open position and a closed position. A roll support extends in a generally horizontal direction between the base and the cover and a passage is formed through the roll support. The passage is defined by an inlet that has an oblong cross-sectional shape and an outlet that is offset in a radial direction toward an edge of the roll support. A restrictor plate is rotationally connected to the roll support and includes a plurality of restrictor holes that are formed through the restrictor plate. Each of the restrictor holes is offset in a radial direction from an axis of rotation of the restrictor plate relative to the roll support and is oriented to be selectively axially aligned with the outlet of the passage formed through the roll support such that each of the restrictor holes can be selectively deployed as a portion of the dispense passage defined by the housing.

A further embodiment of the present application that is useable or combinable with one or more of the above aspects or features discloses a method of forming a pull-through dispenser assembly. A housing is provided that has a base and a cover that is moveably connected to the base so the housing provides an open configuration and a closed configuration. A support plate is provided that cooperates with the housing and is oriented to support a roll of web material in a vertical orientation when the dispenser assembly is deployed in an upright vertical orientation. An opening is formed through the support plate and is shaped to have an oblong inlet that extends in a radial direction across a portion of the support plate. A restrictor is provided that has a plurality of dispense openings and that is supported by the support plate such that each of the plurality of dispense openings can be selectively axially aligned with an outlet of the opening formed through the support plate.

Yet a further embodiment combinable or usable with one or more of the aspects, features, or embodiments disclosed above includes a dispenser assembly and method of providing a web material dispenser assembly that is configured to dispense web material in a pull-through manner from a core of a bulk roll of web material. The dispenser assembly includes a housing having a base and a moveable cover. A roll support is disposed in the housing and defines a portion of a material dispense passage. A restrictor plate is supported by the roll support and is rotatable and axially translatable relative thereto. The restrictor plate defines a number of dispense openings that can be selectively aligned with the portion of the dispense passage defined by the roll support such that the characteristics associated with the pull-through dispense activity of the dispenser assembly can be quickly and conveniently configured to achieve a desired dispense action.

It is also to be understood that, although the foregoing description and drawings describe and illustrate in detail the preferred aspects of the present invention, to those skilled in the art to which the present invention relates, the present disclosure will suggest many modifications and constructions as well as widely differing embodiments and applications without departing from the sprit and scope of the invention. The present invention, therefore, is intended to be limited only by the scope of the appended claims and the applicable prior art.

Further, the invention may be implemented in a variety of configurations, using certain features or aspects described herein and others known in the art. Thus, although the invention has been herein shown and described in what is perceived to be the most practical and preferred embodiment, it is to be understood that the invention is not intended to be limited to the specific features set forth above. Rather, it is recognized that modifications may be made by one of skill in the art of the invention without departing from the spirit or intent of the invention and, therefore, the invention is to be taken as including all reasonable equivalents to the subject matter of the claims.

What is claimed is:

1. A pull-through web material dispenser assembly comprising:

a housing that defines a cavity shaped to receive a roll of web material;

a platform disposed in the housing;

a passage formed through the platform and having a frustoconical shape such that a cross-sectional area of the passage reduces as the passage progresses away from the cavity toward atmosphere;

a dispense plate attached to the platform such that the dispense plate is selectively rotatable and slideable along an axis of rotation of the dispense plate relative to the platform; and a plurality of openings formed through the dispense plate, each of the plurality of openings being circumferentially bounded by a body of the dispense plate and oriented relative to the dispense plate and the axis of rotation of the dispense plate such that each of the plurality of openings can be aligned with the passage formed through the platform.

2. The pull-through web material dispenser assembly of claim 1 wherein a cross-section area of the frustoconical shape of the passage is circumferentially bounded by the platform.

3. The pull-through web material dispenser assembly of claim 1 further comprising a toothed interface formed between the dispense plate and the platform.

4. The pull-through web material dispenser assembly of claim 3 wherein the dispense plate is axially movable from a first position wherein the toothed interface inhibits rotation of the dispense plate relative to the platform and a second position wherein the dispense plate can rotate relative to the platform.

5. The pull-through web material dispenser assembly of claim 1 wherein the housing further comprises a base that supports the platform and a cover that is pivotably connected to the base.

6. The pull-through web material dispenser of assembly of claim 5 further comprising a support that extends from the cover toward the base and is oriented to be generally adjacent a portion of the dispense plate when the cover is closed.

7. The pull-though web material dispenser assembly of claim 5 wherein the cover is pivotable relative to the base about an axis that is generally aligned with the axis of rotation of the dispense plate.

8. A center pull-through towel dispenser assembly comprising:

a base;

a cover that is connected to the base and movable between an open position and a closed position;

a roll support extending in a generally horizontal direction between the base and the cover;

a passage formed through the roll support and defined by an inlet having an oblong cross-section shape and an outlet that is offset in a radial direction toward an edge of the roll support;

a restrictor plate that is connected to the roll support so that the restrictor plate is rotatable relative to the roll support and translatable in opposite directions that are aligned with and extend along an axis of rotation of the restrictor plate relative to the roll support; and a plurality of restrictor holes formed through the restrictor plate, each of the restrictor holes being offset in a radial direction from the axis of rotation of the restrictor plate relative to the roll support and oriented to be selectively axially aligned with the outlet of the passage formed through the roll support.

9. The center pull-through towel dispenser assembly of claim 8 further comprising at least one barb that extends from the roll support and is oriented to snap-fittingly secure the roll support to the base.

10. The center pull-through towel dispenser assembly of claim 8 further comprising a shroud that includes a first portion that extends in an outward direction from the base and a second portion that extends in the outward direction from the cover such that the restrictor plate is at least partially radially bounded by the shroud.

11. The center pull-through towel dispenser assembly of claim 8 further comprising a partition that extends in an inward radially direction from the cover and is oriented to inhibit axial translation of the restrictor plate when the cover is oriented in the closed position relative to the base.

12. The center pull-through towel dispenser assembly of claim 8 further comprising a fastener and a bias device that are disposed between the restrictor plate and the roll support and configured to allow selective axial translation of the restrictor plate relative to the roll support.

13. The center pull-through towel dispenser assembly of claim 12 wherein the bias device is configured to bias the restrictor plate toward the roll support.

14. The center pull-through towel dispenser assembly of claim 8 further comprising a lock arrangement configured to prevent rotation of the restrictor plate relative to the roll support when the lock arrangement is engaged and allow rotation of the restrictor plate relative to the roll support when the lock arrangement is unlocked.

15. A method of forming a pull-through dispenser assembly, the method comprising:

providing a housing having a base and a cover moveably connected to the base so the housing provides an open configuration and a closed configuration;

providing a support plate that cooperates with the housing and is oriented toward and axial end of a roll of web material disposed in the housing and oriented in a vertical orientation;

forming an opening through the support plate and shaping the opening to have an oblong inlet that extends in a radial direction across a portion of the support plate;

providing a restrictor having a plurality of dispense openings and that is supported by the support plate;

providing a toothed interface between the restrictor and the support plate; and supporting the restrictor relative to the support plate such that each of the plurality of dispense openings can be selectively axially aligned with an outlet of the opening formed through the support plate.

16. The method of claim 15 further comprising biasing a toothed surface defined by the restrictor into engagement with another toothed surface defined by the support plate.

17. The method of claim 15 further comprising supporting the restrictor relative to the support plate such that the restrictor is axially translatable relative to support plate to disengage the toothed interface so that the restrictor is rotatable relative to the support plate when the toothed interface is disengaged.

18. The method of claim 15 further comprising forming the cover to interfere with axial translation of the restrictor relative to the support plate when the housing is in the closed configuration.

19. The method of claim 18 further comprising forming the opening through the support plate to be circumferentially bounded by the support plate and forming each of the plurality of dispense openings of the restrictor to be circumferentially bounded.

20. A pull-through web material dispenser assembly comprising:

a housing that defines a cavity shaped to receive a roll of web material;

a platform disposed in the housing;

a passage formed through the platform and having a frustoconical shape such that a cross-sectional area of the passage reduces as the passage progresses away from the cavity toward atmosphere;

a dispense plate attached to the platform such that the dispense plate is rotatable relative thereto;

a plurality of openings formed through the dispense plate, each of the plurality of openings being oriented relative to the dispense plate and an axis of rotation of the dispense plate such that each of the plurality of openings can be aligned with the passage formed through the platform; and a toothed interface formed between the dispense plate and the platform.

* * * * *